US011047156B2

(12) United States Patent
Liu et al.

(10) Patent No.: US 11,047,156 B2
(45) Date of Patent: Jun. 29, 2021

(54) COMPRESSION LATCH HAVING A REDUCED PROTRUSION

(71) Applicant: Southco, Inc., Concordville, PA (US)

(72) Inventors: Xiaojun Liu, Shanghai (CN); Richard B. Langkamp, Jr., Hemlock, NY (US); Hailu Wang, Concordville, PA (US)

(73) Assignee: Southco, Inc., Concordville, PA (US)

( * ) Notice: Subject to any disclaimer, the term of this patent is extended or adjusted under 35 U.S.C. 154(b) by 459 days.

(21) Appl. No.: 15/575,095

(22) PCT Filed: Jul. 12, 2016

(86) PCT No.: PCT/US2016/041873
§ 371 (c)(1),
(2) Date: Nov. 17, 2017

(87) PCT Pub. No.: WO2017/011443
PCT Pub. Date: Jan. 19, 2017

(65) Prior Publication Data

US 2018/0148958 A1 May 31, 2018

Related U.S. Application Data

(60) Provisional application No. 62/192,264, filed on Jul. 14, 2015.

(51) Int. Cl.
*E05C 3/04* (2006.01)
*E05C 5/00* (2006.01)
*E05B 17/00* (2006.01)

(52) U.S. Cl.
CPC ..... *E05C 3/042* (2013.01); *E05B 17/0025* (2013.01); *E05C 5/00* (2013.01)

(58) Field of Classification Search
CPC ... E05C 3/042; E05C 5/00; E05C 5/02; E05C 3/004; E05C 3/041; E05C 3/12;
(Continued)

(56) References Cited

U.S. PATENT DOCUMENTS 4,583,775 A * 4/1986 Bisbing ..... E05B 17/0025 292/64
4,671,547 A * 6/1987 Weinerman ..... E05C 3/042 292/197

(Continued)

FOREIGN PATENT DOCUMENTS

CN 1089324 A 7/1994
CN 1526048 A 9/2004

(Continued)

OTHER PUBLICATIONS

Chinese Office Action for Chinese Application No. 201680004074.X, dated Mar. 28, 2019, with translation, 13 pages.

(Continued)

*Primary Examiner* — Mark A Williams
(74) *Attorney, Agent, or Firm* — RatnerPrestia

(57) ABSTRACT

According to one aspect of the invention, a latch is configured to fix a panel relative to a frame. The latch includes a housing configured for engagement to the panel. The latch also includes a cap mounted within the housing and a shaft extending along a longitudinal axis within the housing. A spring of the latch is configured to bias the shaft away from the cap along the longitudinal axis, and a sleeve of the latch interposed between the shaft and the housing, the sleeve defining a first slot. The latch also includes a cam interposed between the shaft and the housing, the cam defining a second slot. A pin is provided which extends into the first and second slots. The first and second slots are configured to guide the rotation and axial movement of the shaft as the cap is rotated within the housing.

10 Claims, 18 Drawing Sheets

(58) Field of Classification Search
CPC .... E05C 3/145; E05B 17/0025; E05B 35/008; E05B 17/04; E05B 33/00; Y10T 292/1016; Y10T 292/1043; Y10T 292/1077; Y10T 70/5314; Y10T 292/0889
See application file for complete search history.

(56) References Cited

U.S. PATENT DOCUMENTS

| | | | | |
|---|---|---|---|---|
| 4,679,835 | A | 7/1987 | Weinerman et al. | |
| 5,076,080 | A * | 12/1991 | Fuss | E05C 3/042 292/66 |
| 5,335,950 | A | 8/1994 | Mirshafiee et al. | |
| 5,961,162 | A * | 10/1999 | Glaser | E05B 9/08 292/198 |
| 6,640,592 | B2 * | 11/2003 | Vickers | E05B 17/04 292/64 |
| 7,695,031 | B2 | 4/2010 | Jackson, Jr. et al. | |
| 2002/0166353 | A1 * | 11/2002 | Vickers | E05B 17/04 70/127 |
| 2006/0236732 | A1 * | 10/2006 | Hoffman | E05C 3/042 70/127 |
| 2008/0105014 | A1 * | 5/2008 | Vickers | E05B 17/0025 70/404 |
| 2019/0063112 | A1 * | 2/2019 | Carabalona | E05B 41/00 |
| 2019/0338569 | A1 * | 11/2019 | Manly | E05B 17/18 |
| 2020/0048929 | A1 * | 2/2020 | Carabalona | E05C 3/042 |

FOREIGN PATENT DOCUMENTS

| | | | |
|---|---|---|---|
| CN | 101107414 | A | 1/2008 |
| CN | 101144346 | A | 3/2008 |
| CN | 201187198 | Y | 1/2009 |
| GB | 2158866 | A | 11/1985 |
| GB | 20172648 | A | 9/1986 |
| GB | 2411891 | A | 3/2008 |
| WO | 9916903 | A1 | 4/1999 |

OTHER PUBLICATIONS

International Preliminary Report on Patentability and Written Opinion for International Application No. PCT/US2016/041873, dated Jan. 16, 2018, 7 pages.
International Search Report and Written Opinion for International Application No. PCT/US2016/041873, dated Oct. 25, 2016—10 Pages.
Indian First Examination Report for Indian Application No. 20171700297, dated Jun. 29, 2020 with translation, 6 pages.
Japanese Notice of Reasons for Rejection for Japanese Application No. 2017-514448, dated Jul. 28, 2020 with translation, 5 pages.

* cited by examiner

SECTION F – F

SECTION A – A

SECTION B–B

SECTION C–C

SECTION A – A

SECTION B – B

SECTION P-P

SECTION H–H

SECTION J – J

COMPRESSION LATCH HAVING A REDUCED PROTRUSION

CROSS-REFERENCE TO RELATED APPLICATIONS

This application is a U.S. National Phase Application of PCT International Application PCT/US2016/041873, filed Jul. 12, 2016, which claims priority to U.S. Provisional Patent Application No. 62/192,264, entitled COMPRESSION LATCH HAVING A REDUCED PROTRUSION, filed on 14 Jul. 2015, the contents of each of which are incorporated herein by reference in their entirety.

FIELD OF THE INVENTION

The present invention relates generally to latches, and particularly, to compression latches that can be used for securing storage compartments and can provide for reduced protrusion of the latches into such compartments.

BACKGROUND OF THE INVENTION

Conventionally, storage compartments in restricted areas (such as medical environments for example) must be secured to prevent unauthorized access to their contents. Latches may be used to restrict access to such compartments to users having a corresponding key.

Depending on the environment or intended use, many storage compartments may have a united amount of available space, or may store objects that take up substantially all of the space within the compartment. For these types of compartments, it may be advantageous that the latch used for securing the compartment not unnecessarily protrude or impinge upon the limited space available. Accordingly, improved systems and devices are desired for securing storage compartments without negatively impacting available storage space yet while maintaining good latch performance.

SUMMARY OF THE INVENTION

Aspects of the present invention are related to latches.

According to one aspect of the invention, a latch is configured to fix a panel elative to a frame. The latch includes a housing configured for engagement to the panel, the housing having a longitudinal axis and defining an aperture along the longitudinal axis. The latch also includes a cap mounted within the aperture of the SEE housing for rotation about the longitudinal axis, the cap defining a longitudinally extending recess. Also included in the latch is a shaft extending along the longitudinal axis within the aperture of the housing, the shaft being mounted for rotation about the longitudinal axis, the shaft further being mounted for axial movement relative to the cap, the shaft having a guide portion movably received in the recess of the cap. A spring of the latch is configured to bias the shaft away from the cap along the longitudinal axis, and a sleeve of the latch is interposed between the shaft and the housing, the sleeve defining a first slot. The latch also includes a cam interposed between the shaft and the housing, the cam being rotatable relative to the sleeve about the longitudinal axis, the cam defining a second slot. A pin is provided extending radially outwardly from the shaft relative to the longitudinal axis, the pin extending into fs the first and second slots. The latch also includes a pawl coupled to the shaft, the pawl being configured to engage the frame. The first and second slots are configured to guide the rotation and axial movement of the shaft as the cap is rotated within the housing such that the pawl engages or disengages the frame.

The cap can include a drive stud extending along the longitudinal axis and forming a drive surface for rotating the cap. If so, the recess of the cap can be at least partially defined within the drive stud.

The cap can also define a drive opening extending along the longitudinal axis and forming a drive surface for rotating the cap. If so, the recess of the cap can overlap with the drive opening in a radial direction of the cap, and the recess of the cap can extend to a position radially outward from the drive opening.

The spring can be positioned to surround the guide portion of the shaft, and the spring can extend between opposed surfaces of the shaft and the cap and have ends abutting the opposed surfaces. The opposed surface of the cap can be formed within the recess of the cap. The spring can include one or more of the following elements: compression springs, wave springs, belleville washers, elastomeric springs, and/or conical springs.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features may be arbitrarily expanded or reduced for clarity. Included in the drawings are the following figures.

DETAILED DESCRIPTION OF THE INVENTION

Figure 1:
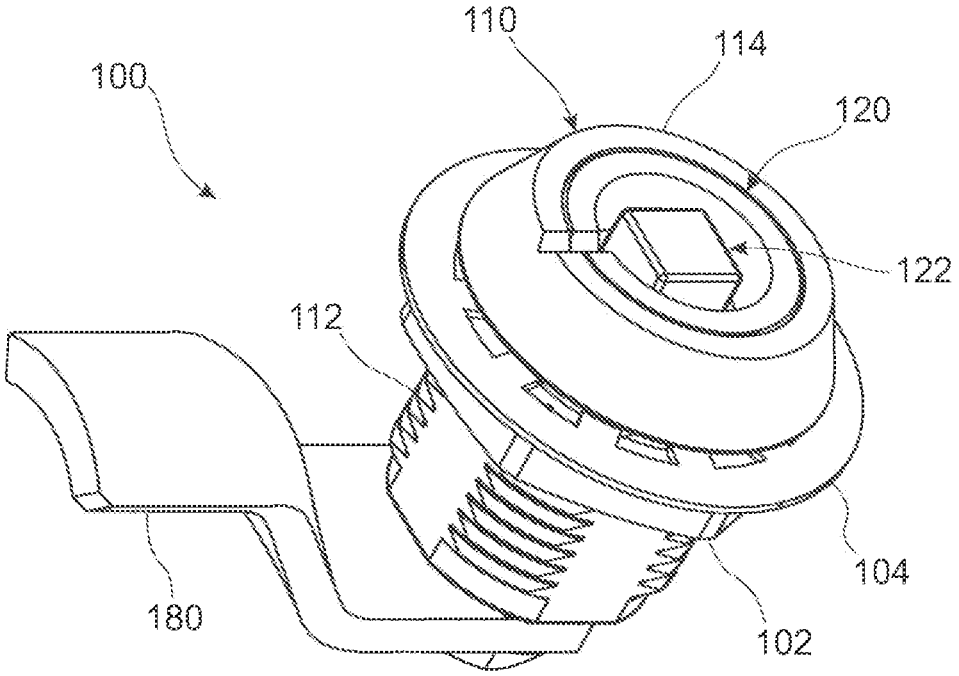
FIG. 1 depicts an exemplary latch configured to fix a panel relative to a frame in accordance with aspects of the present invention.

Although the invention is illustrated and described herein with reference to specific embodiments, the invention is not intended to be limited to the details shown. Rather, various modifications may be made in the details within the scope and range of equivalents of the claims and without departing from the invention.

The exemplary latches described herein have a lower profile than conventional latches for storage compartments in that they can provide for a reduction of the degree of the protrusion of the latch into such compartments, decreasing or eliminating the effect of the latch on available storage space. These embodiments generally incorporate a latch cap and shaft which rotatably and axially move to open or close the compartment.

While particular latch embodiments are described herein, components the disclosed embodiments may be incorporated into any conventional latches known to one of ordinary skill in the art to achieve the advantages described herein. For example, components of the disclosed embodiments may be it into those latches described in U.S. Pat. No. 4,583,775, the contents of which are incorporated herein by reference in their entirety. Likewise, the disclosed latches may be usable on any structure, including any type of storage compartments in which it is desirable to secure the contents of the compartment. The latch is preferably a compression latch for use with a panel mounted to a frame. Such a compression latch is configured for movement from an open position in which a panel is not latched relative to the frame, to a latched position in which the panel is latched relative to the frame, and to a locked position in which the panel is pulled against the frame such that they are compressed against one another.

Referring now to the drawings, FIGS. 1-8C illustrate an exemplary latch 100 in accordance with aspects of the present invention. Latch 100 is configured to fix a panel 10 relative to a frame 20, as shown in FIGS. 6A, 7A, and 8A. As a general overview, latch 100 includes a housing 110, a cap 120, a shaft 130, a spring 140, a sleeve 150, a cam 160, pin 170, and a pawl 180. Additional details of latch 100 are described below.

Housing 110 houses the components of latch 100. Housing 110 is configured for engagement to panel 10. In an exemplary embodiment, housing 110 has a body portion 112 sized to fit within a through-hole in panel 10. Housing 110 further includes a flanged portion 114 extending circumferentially around an outer surface of body portion 112. Flanged portion 114 is sized to contact an inner or outer surface of panel 10 when body portion 112 of housing 110 is received within the through-hole.

In a preferred embodiment, housing 110 engages with panel 10 using a nut 102. Nut 102 is adapted to be screwed onto threading 115 formed on the outer surface of body portion 112, such that panel 10 is clamped between flanged portion 114 and nut 102. A washer 104 may be added between panel 10 and nut 102 to create an appropriate securement of latch 100 to panel 10. Additionally, a gasket (not shown) may be added between panel 10 and the flanged portion 114 of the housing 110 to secure the interior of the compartment from external elements such as liquid or dust. The use of nut 102 within the compartment to secure latch 100 to panel 10 desirably prevents unauthorized removal of latch 100 from panel 10.

Alternatively or additionally, housing 110 may engage with panel 10 by any other means, including for example a frictional or threaded fit of body portion 112 within the through-hole of panel 10 or adhering the flanged portion 114 to the surface of panel 10. For example, a fastener such as a screw can be used as can bracket mounting configurations. Still further, a portion or all of housing 110 may be formed an integral or unitary piece with panel 10.

Body portion 112 of housing 110 extends along a longitudinal axis. As shown in FIGS. 6C, 7C, and 8C, the longitudinal axis generally extends in a direction orthogonal to the plane of panel 10. Nonetheless, it will be understood from the description herein that the longitudinal axis may extend at an oblique angle relative to panel 10, and the direction of the longitudinal axis is not intended to be limited.

Body portion 112 of housing 110 further defines an aperture 116 therein which extends along the longitudinal axis. Aperture 116 is sized to accommodate the components of latch 100, as described below.

Housing 110 may further include at least indicator 118, as shown in FIGS. 3A-3E. Indicator 118 may be provided to indicate to a user the rotational location of the start or end point of the keyed components of the latch. In an exemplary embodiment, indicator 118 is a notch which, when aligned with a corresponding indicator 125 of cap 120, indicates to the user that cap 120 is in the unrotated (secured or locked) position. The latch is moveable from an open position in which a panel is not latched relative to the frame, to a latched position in which the panel is latched relative to the frame, and to a locked position in which the panel is pulled against the frame such that they are compressed against one another.

Cap 120 is mounted at least partially within aperture 116 of housing 110. Cap 120 is not affixed to housing 110, so that it can rotate relative to housing 110 around the longitudinal axis. As shown in FIGS. 4A-4E, cap 120 may have a circular shape in order to enable unobstructed rotation of cap 120 within housing 110.

Cap 120 may be prevented from axial movement relative to housing 110. In an exemplary embodiment, cap 120 includes a retainer 121. Retainer 121 may be formed as a split ring which surrounds an outer surface of cap 120. Retainer 121 is accommodated within a groove 123 formed along the outer circumferential surface of cap 120 and a corresponding groove 113 formed along the inner circumferential surface of housing 110. When retainer 121 is seated within grooves 113 and 123, it prevents axial movement of cap 120 out of the aperture 116 defined by body portion 112.

In a preferred embodiment, a gasket such as an o-ring 106 may be added between housing 110 and cap 120 in order to secure the interior of body portion from external elements such as liquid or dust. Cap 120 and/or housing 110 may include all annular groove or surface for accommodating gasket 106 between cap 120 and housing 110.

Cap 120 includes at least one drive surface 122 on its upper surface, as shown in FIGS. 4A-4E. Drive surface 122 is accessible when cap 120 is mounted within housing 110, in order to enable a user to drive or rotate cap 120, e.g., with a key. Drive surface 122 may be formed with a shape corresponding to a shape of a key (not shown). In this form, cap 120 cannot readily be rotated relative to housing 110 without the corresponding key for engaging with drive surface 122.

Cap 120 further includes at least one longitudinally extending recess 124. Recess 124 is formed in a lower surface of cap 120, opposite drive surface 122. Recess 124 is formed to mate with a portion of shaft 130, as described below.

In one embodiment, cap 120 comprises a drive stud 126 extending from an upper surface of cap 120 along the longitudinal axis. Drive stud 126 may form the drive surface 122 for rotating cap 120. In this embodiment, recess 124 overlaps with drive stud 126 in the radial direction of housing 110. In other words, recess 124 is at least partially defined within drive stud 126.

Alternatively or additionally, cap 120 comprises a drive opening 128 extending into an upper surface of cap 120 along the longitudinal axis. Drive opening 128 may also form the drive surface 122 for rotating cap 120. In this embodiment, recess 124 overlaps with drive opening 128 in the radial direction of housing 110. In other words, recess 124 extends longitudinally to a position that is either radially outward from or radially inward from drive opening 128.

Overlap between recess 124 and the drive surface 122 of cap 120 is advantageous to lower the protrusion of latch 100. As set forth below, recess 124 is provided in order to define the direction of axial movement of shaft 130 during opening of latch 100. By creating a radial overlap between recess 124 and drive surface 122 (defined by drive stud 126 and/or drive opening 128), the overall height H of cap 120 (shown in FIG. 4C) and/or the length of the shaft 130 may be decreased, and the overall protrusion P of latch 100 (shown in FIG. 6C) may be lowered. Preferably, latch 100 has an overall protrusion P of no more than approximately 30 mm measured from the outer surface of the panel (corresponding to the bottom edge of the flanged portion 114 extending circumferentially around an outer surface of body portion 112 of the housing 110) to the base of the screw 182. A conventional latch may have a protrusion P of about 40 mm. This protrusion P can, for example, be reduced to about 30 mm according to an exemplary embodiment of this invention.

The embodiments illustrated in the figures are of a fixed grip style in which the position of the mounting of the pawl on the body of the latch is fixed in longitudinal position by the screw 182 and the housing 110. In other words, the position of the pawl cannot be easily adjusted by the user in this embodiment. In another embodiment having an adjustable grip feature, the position of the mounting of the pawl on the body of the latch can be adjusted using, for example, nuts to capture the position of the pawl at a user-selected position. A conventional latch having an adjustable grip feature may have a longer protrusion P of about 64 mm for example. This protrusion P can, for example, be reduced to about 54 mm according to an exemplary embodiment of this invention. In other words, protrusion P can be reduced by up to about 10 mm or even more for various latch configurations as compared to conventional latch designs.

Figure 8A:
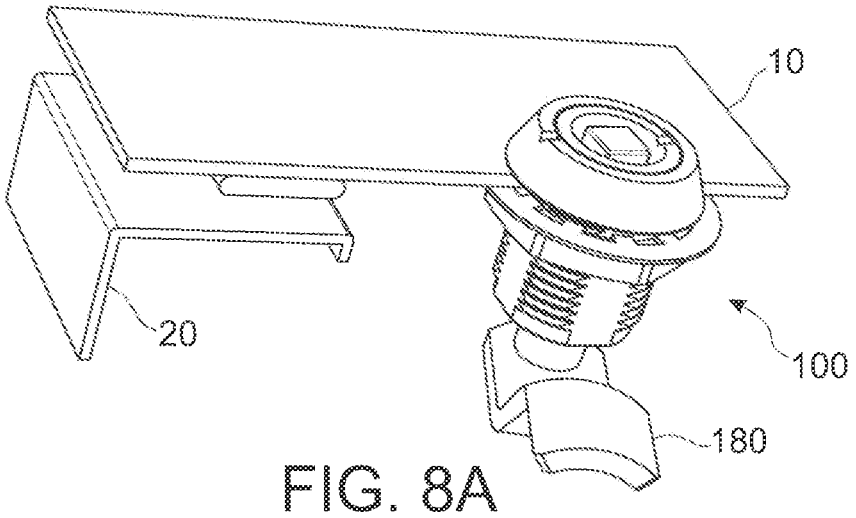
FIGS. 8A-8C depict a third step of the opening operation of FIGS. 6A-6C.
Figure 7A:
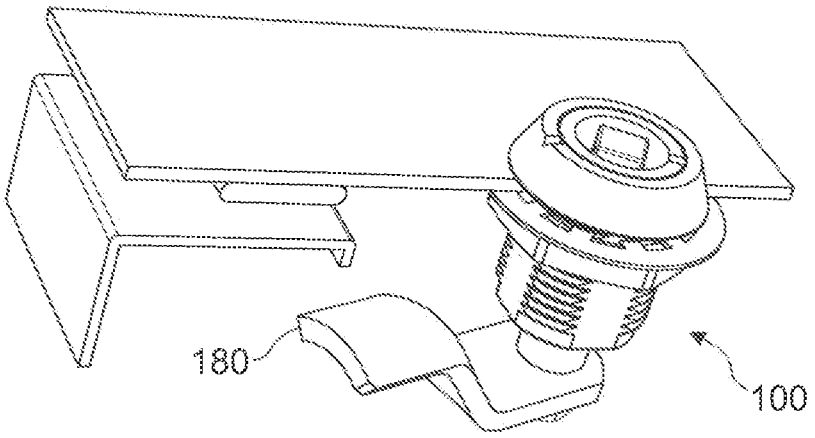
FIGS. 7A-7C depict a second step of the opening operation of FIGS. 6A-6C.
Figure 6A:
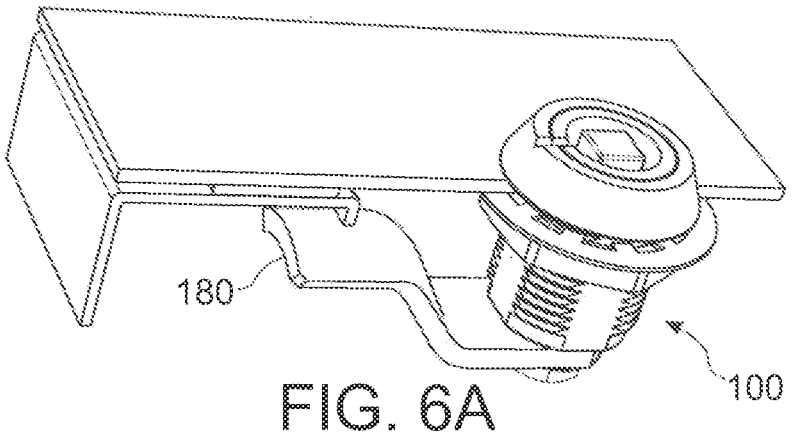
FIGS. 6A-6C depict a first step of an exemplary opening operation of the latch of FIG. 1 with a panel and frame.

As shown in FIGS. 6A, 7A, and 8A, a panel 20 and a gasket (not shown) are positioned between the panel 20 and the bottom edge of the flanged portion 114 extending circumferentially around an outer surface of body portion 112 of the housing 110. The panel 20 and gasket are not shown in FIGS. 6C, 7C, and 8C; instead, a gap represents the space that would otherwise be occupied by the panel 20 and the gasket.

Cap 120 may further includes at least one indicator 125. Indicator 125 may be provided to indicate to a user the rotational location of cap 120 relative to housing 110. In an exemplary embodiment, indicator 125 is a notch which is positioned to align with a corresponding indicator 118 on housing 110 to indicate to the user when cap 120 is in the unrotated (secured) position.

Shaft 130 is mounted at least partially within aperture 116 of housing 110. Shaft 130 extends along the longitudinal axis of housing 110. Shaft 130 is mounted to be rotatable around the longitudinal axis relative to housing 110 and cap 120. As shown in FIGS. 5A-5E, shaft 130 may have a circular shape in order to enable unobstructed rotation of shaft 130 within housing 110.

Shaft 130 is mounted to be axially movable relative to housing 110 and cap 120. In an exemplary embodiment, shaft 130 includes a guide portion 132. Guide portion 132 extends upward from shaft 130 in the axial direction toward cap 120. Guide portion 132 is sized to be received within recess 124 of cap 120. The sliding engagement of guide portion 132 within recess 124 defines the direction of the axial movement of shaft 130 relative to cap 120.

Shaft 130 further includes a through-hole 134. Through-hole extends in the radial direction through the body of shaft 130. Through-hole 134 is shaped to accommodate a pin 170 passing through shaft 130, as described in further detail below.

Shaft 130 further includes a threaded recess 136 in a lower end thereof. Threaded recess 136 is sized to accommodate a screw 182 for affixing pawl 180, as described in further detail below.

Spring 140 is configured to bias shaft 130 away from cap 120 along the longitudinal axis. In an exemplary embodiment, spring 140 is a compression spring positioned to surround guide portion 132 of shaft 130. The spring can include one or multiple elements, such as compression springs, wave springs, belleville washers, elastomeric springs, and/or conical springs. Spring 140 extends from a surface 127 on cap 120 to an opposing surface 138 on shaft 130, and has ends abutting the respective surfaces 127 and 138. In an exemplary embodiment, surface 127 of cap 120 is defined within recess 124, in order to reduce or further reduce the overall height H of cap 120.

Sleeve 150 is positioned within aperture 116 interposed between housing 110 and shaft 130. Sleeve 150 thus defines an aperture in which shaft 130 is positioned.

Sleeve 150 is mounted within housing 110 in such a manner to prevent rotation of sleeve 150 relative to housing 110. In an exemplary embodiment, sleeve 150 includes one or more keying features 152 positioned to mate with keying features 119 in housing 110. Keying features 152 and 119 may be detents, projections, recesses, or any other anti-rotation structures known to one of ordinary skill in the art from the description herein. Alternatively, all or a portion of sleeve 150 may be formed integrally or as a unitary piece with housing 110.

Figure 2:
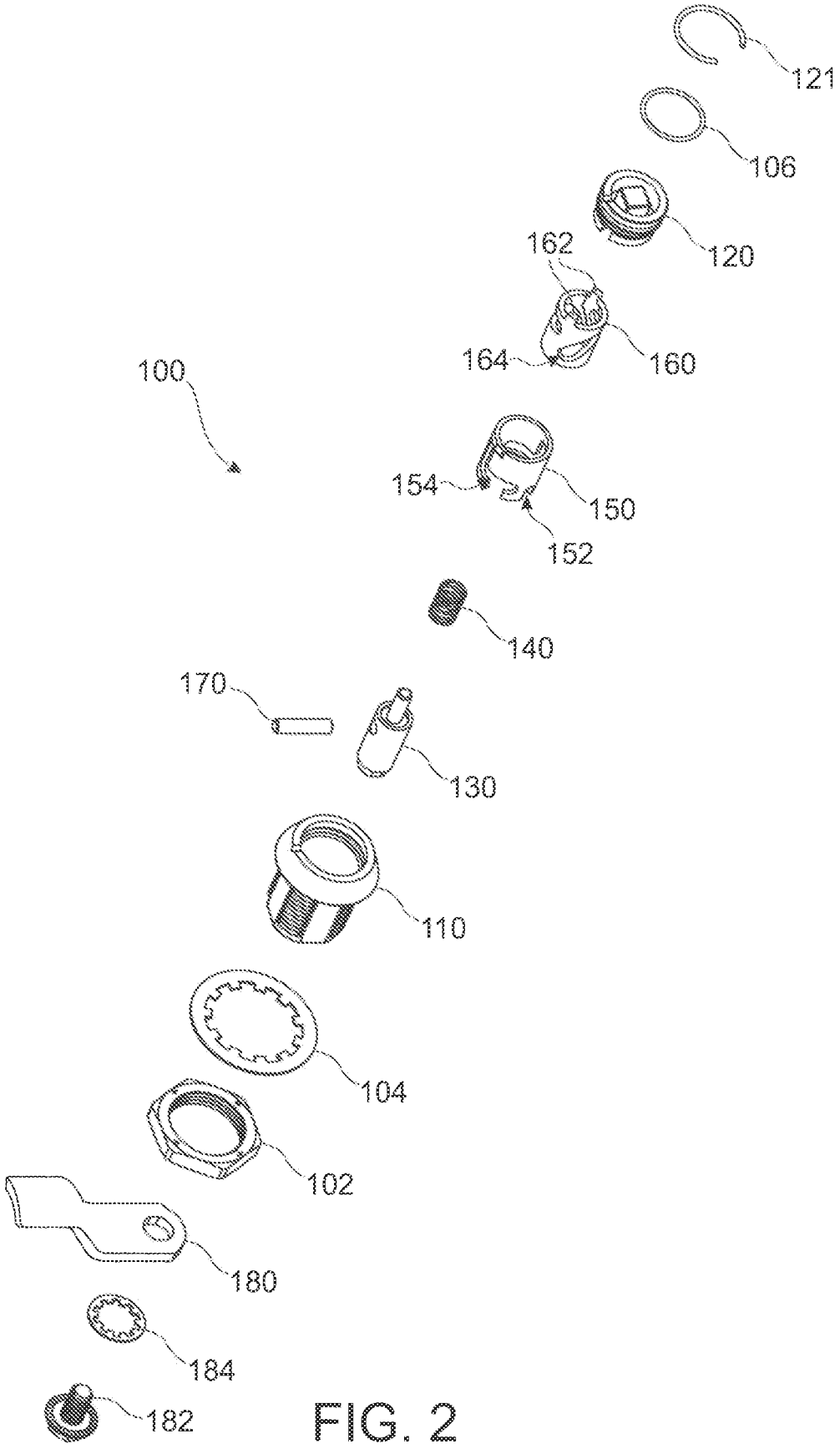
FIG. 2 depicts an exploded view of the latch of FIG. 1.
Figure 2A:
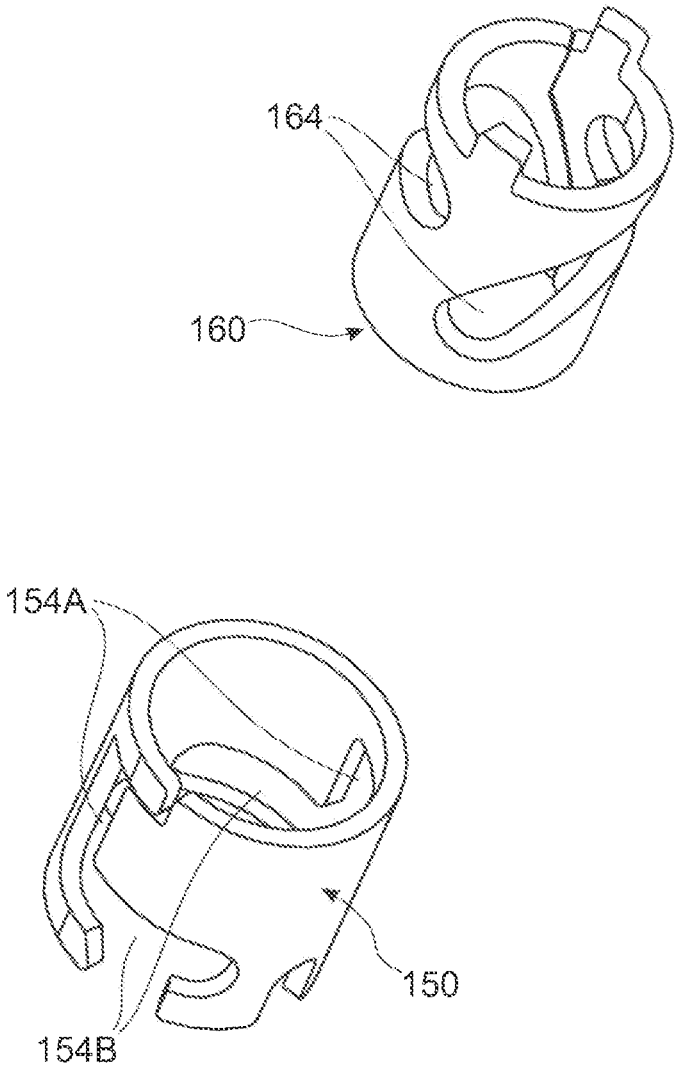
FIG. 2A depicts an enlarged exploded view of components of the latch of FIG. 1.
Figure 3B:
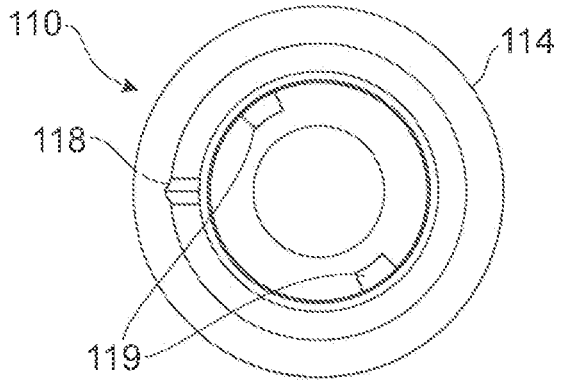
FIGS. 3A-3E depict an exemplary housing of the latch of FIG. 1.
Figure 3A:
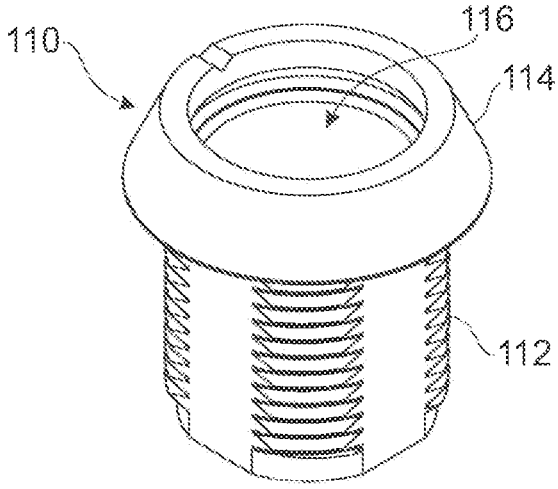
Figure 3C:
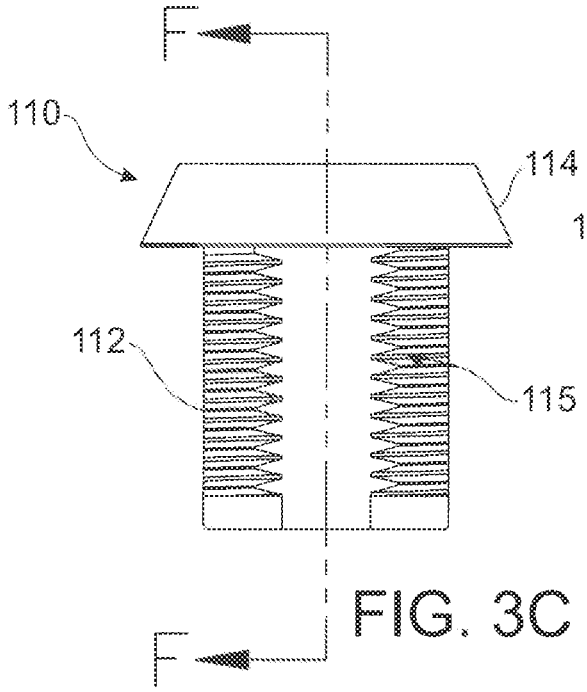
Figure 3E:
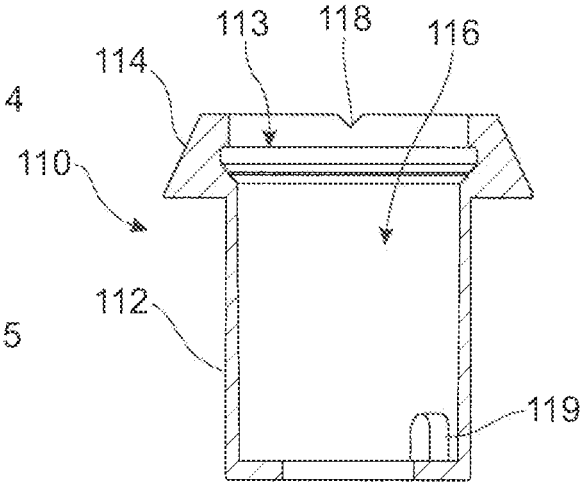
Figure 3D:
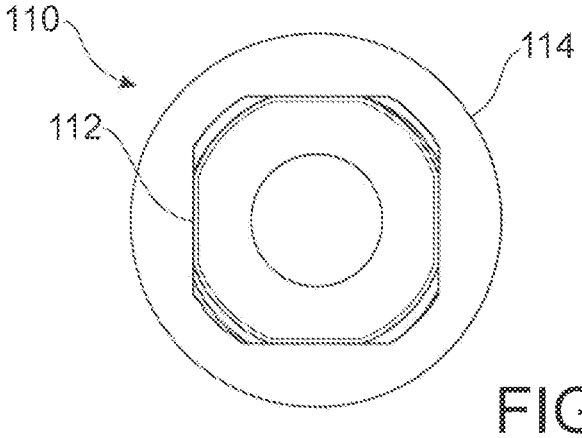
Figure 4B:
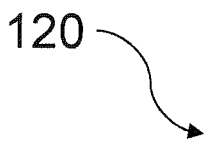
FIGS. 4A-4E depict an exemplary cap of the latch of FIG. 1.
Figure 4B:
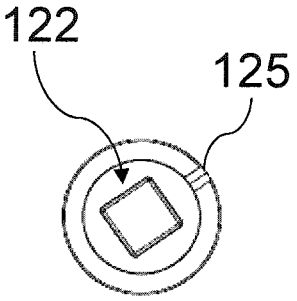
Figure 4A:
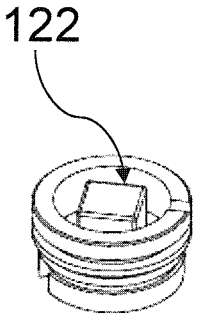
Figure 4C:
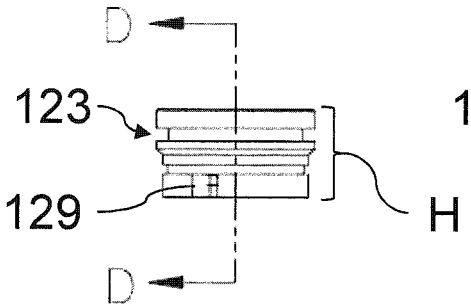
Figure 4E:
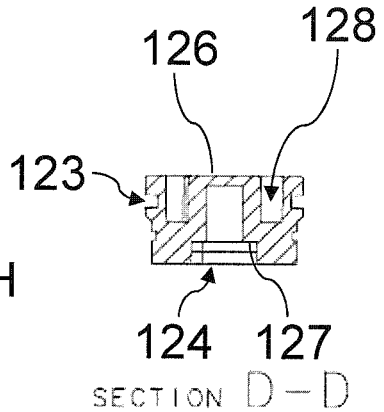
Figure 4D:
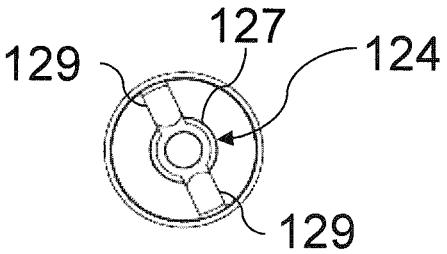
Figure 5B:
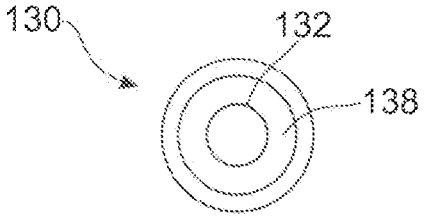
FIGS. 5A-5E depict an exemplary shaft of the latch of FIG. 1.
Figure 5A:
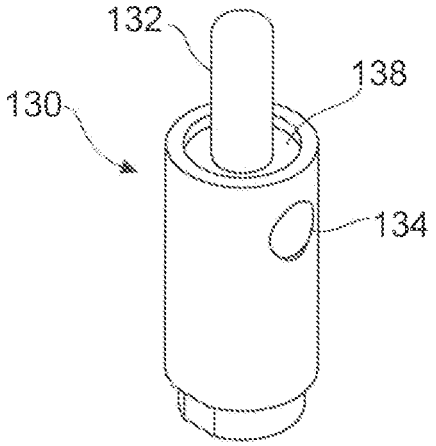
Figure 5C:
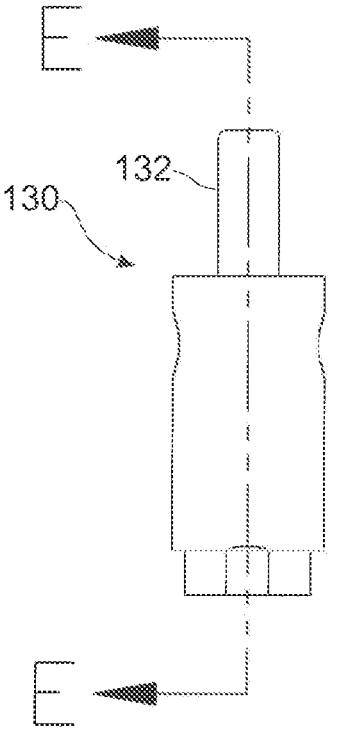
Figure 5E:
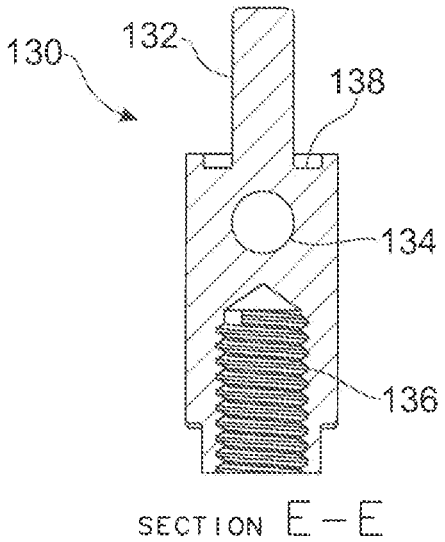
Figure 5D:
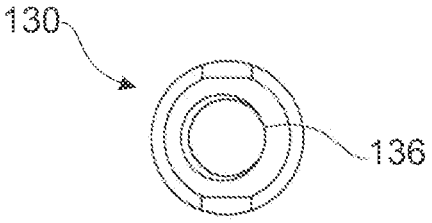

Sleeve 150 defines a pair of slots 154. Slots 154 are sized to receive pin 170 therein, and to allow axial and/or circumferential movement of pin 170 along each slot 154. In an exemplary embodiment, and referring to FIG. 2A which shows an enlarged exploded view of the sleeve 150 and cam 160, each slot 154 has an L-shape, with a first portion 154A extending in the longitudinal or axial direction of housing 110, and a second portion 154B extending, in the circumferential direction of housing 110. The first and second portions 154A, 154B of each slot 154 guide the movement of shaft 130 within housing 110 during an opening or closing operation of latch 100, as described in greater detail below.

Cam 160 is positioned within the aperture of sleeve 150 interposed between sleeve 150 and shaft 130. Cam 160 is mounted within sleeve 150 to be rotatable relative sleeve 150 around the longitudinal axis. In particular, cam 160 is mounted to be rotatable with cap 120. In an exemplary embodiment, cam 160 includes one or more keying features 162 positioned to mate with keying features 129 in the lower surface of cap 120. Keying features 162 and 129 may be detents, projections, recesses, or any other anti-rotation structures known to one of ordinary skill in the art from the description herein.

Cam 160 defines a pair of slots 164. Slots 164 are sized to receive pill 170 therein, and to allow axial and/or circumferential movement of pin 170 along each slot 164. In an exemplary embodiment, each slot 164 is spirally curved around the outer circumferential surface of cam 160 between a first Position near cap 120 and a second position axially spaced from the first position away from cap 120. With slots 154, slots 164 guide the movement of shaft 130 within housing 110 during an opening or closing operation of latch 100, as described in greater detail below.

While cam 160 is described as being positioned within sleeve 150, it will be understood that the invention is not so limited. Cam 160 could alternatively be positioned outside of sleeve 150, such that sleeve 150 is interposed between cases 160 and shaft 130, without departing from the scope of the invention.

Additionally, while cam 160 is described as being a separate component from cap 120, it will be understood that the invention is not so limited. Alternatively, all or a portion of cam 160 could be formed integrally or as a unitary piece with cap 120. Such a structure may be desired in order to further minimize the overall protrusion P of latch 100.

Pin 170 extends radially outward from shaft 130 relative to the longitudinal or axial direction of housing 110. Pin 170 is captured within an aperture formed in the shaft 130, and is received with slots 154 and 164. As a result, shaft 130 is limited to moving rotationally or axially within the path defined by the engagement of pin 170 with slots 154 and 164.

In an exemplary embodiment, pin 170 is a cylindrical post extending diametrically through through-hole 134 of shaft 130. The post has a length sufficient to form diametrically opposed pins 170 on either side of shaft 130. In this embodiment, sleeve 150 and cam 160 may each include a pair of diametrically opposed slots 154 and 164 on, either side thereof. Accordingly, while the operation, of latch 100 is described herein with respect to a single slot 154, 164 and pin 170, it will be understood by one of ordinary skill in the art that one, two, or more respective slots and pins may be used without departing from the scope of the invention.

Pawl 180 is coupled to shaft 130. In an exemplary embodiment, pawl 180 is fixedly coupled to the lower end of shaft 130 via a screw 182 that is engaged with threaded recess 136. A washer 184 may be added between screw 182 and pawl 180 to create an appropriate securement of pawl 180 to shaft 130. Pawl 180 is movable between a closed position and an open position.

Pawl 180 is moved between the closed position and the open positioned by rotation and axial movement of shaft 130. In the closed position, shown in FIG. 6A, pawl 180 engages frame 20 and fixes panel 10 relative to frame 20. In the open position, shown in FIG. 8A, pawl 180 disengages from frame 20, and allows relative movement of panel 10 relative to frame 20.

An exemplary operation of latch 100 is described below with respect to FIGS. 6A-8C. As will be evident from the description below, the slots 154 and 164 are configured to guide the rotation and axial movement of shaft 130 as cap 120 is rotated within housing 110, such that pawl 180 engages with or disengages from frame 20.

Figure 6B:
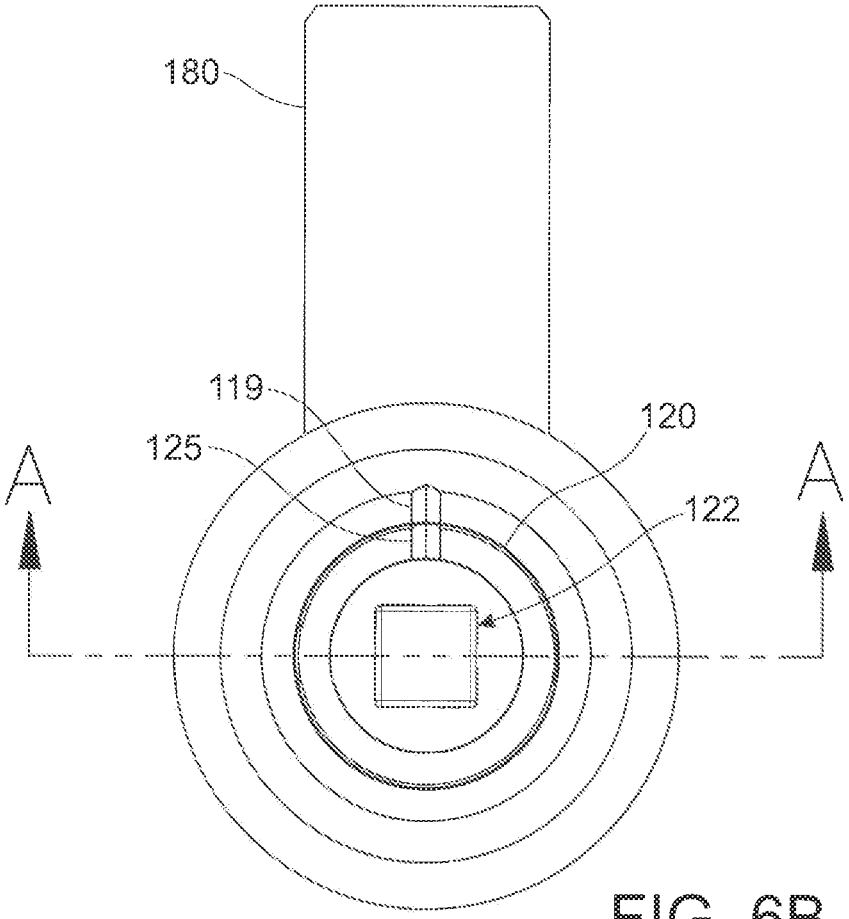
Figure 6C:
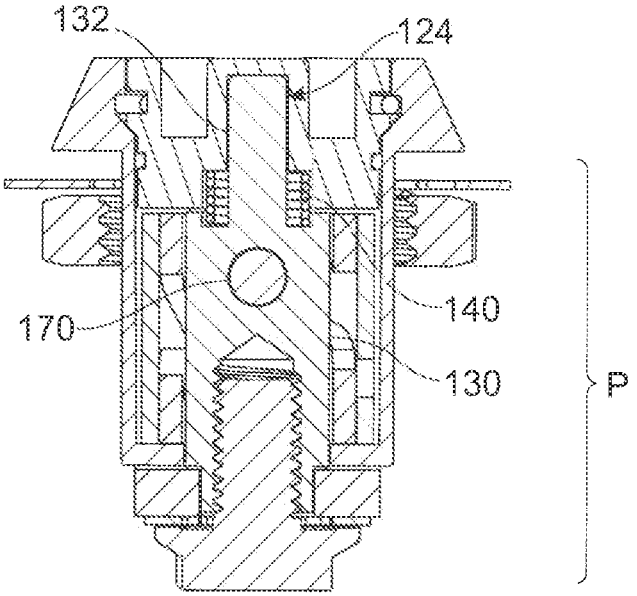

FIGS. 6A-6C show latch 100 in the closed position. As shown in FIG. 6A, pawl 180 is rotated to engage with frame 20 in the closed position. As shown in FIG. 6B, indicators 118 and 125 are aligned, indicating to the user that cap 120 is in the unrotated (secured) position. As shown in FIG. 6C, shaft 130 is at an axially uppermost position, with guide portion 132 fully received within recess 124 of cap 120, and spring 140 fully compressed.

At this stage, in order to open latch 100, a user engages a key with drive surface 122 of cap 120 and begins rotating. Rotating cap 120 causes a corresponding rotation of cam 160, e.g., due to keying features 162 and 129. As cam 160 rotates, the spiral slot 164 of cam 160 applies a force to pin 170 in an axial and circumferential direction. The first portion of the L-shaped slot 154 allows movement of pin 170 in the axial direction, and prevents movement of pin 170 in the circumferential direction. As a result, rotation of cap 120 and cam 160 from the closed position causes pin 170, and correspondingly shaft 130, to move only in the axial direction away from cap 120 (under bias from spring 140). This axial movement of shaft 130 moves pawl 180 axially downward and away from frame 20. The axial movement of pin 170 proceeds until pin 170 reaches the second portion of L-shaped slot 154.

Figure 7B:
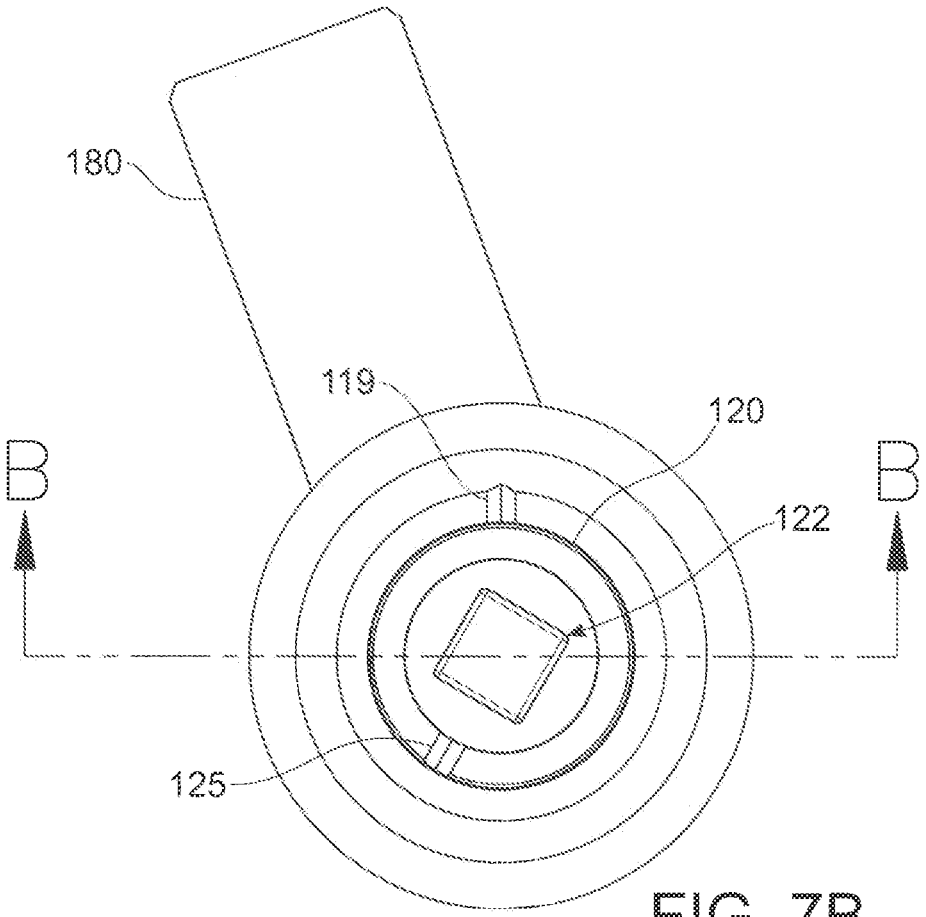
Figure 7C:
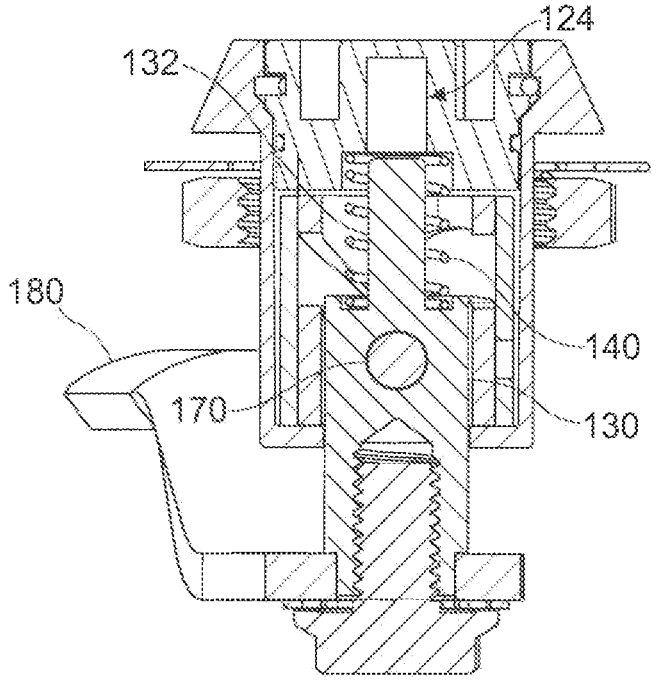

FIGS. 7A-7C show latch 100 in a position between the opened and closed positions, after pin 170 reaches the second portion of L-shaped slot 154. As cam 160 continues to rotate, the spiral slot 164 of cam 160 continues to apply a force to pin 170 in an axial and circumferential direction. The second portion of the L-shaped slot 154 prevents further movement of pin 170 in the axial direction, but allows movement of pin 170 in the circumferential direction. As a result, continued rotation of cap 120 and cam 160 causes pin 170, and correspondingly shaft 130, to move only in the rotational or circumferential direction. This rotational movement of shaft 130 moves pawl 180 rotationally away from frame 20. As shown in FIGS. 7A and 7B, pawl 180 has begun to rotate away from frame 20 toward the open position. As shown in FIG. 7B, indicators 118 and 125 are no longer aligned, as cap 120 has been rotated counterclockwise from the closed position. As shown in FIG. 7C, shaft 130 is at an axially lowermost position, with spring 140 fully extended. Shaft 130 has begun to rotate, and the cross-section of pin 170 shown in FIG. 7C is slightly elliptical in shape.

While the exemplary embodiment in FIGS. 7A-7C (and elsewhere herein) depict a counterclockwise rotation of the cap, it will be understood that the operations described herein may alternatively be performed with a clockwise rotation of the cap.

Figure 8B:
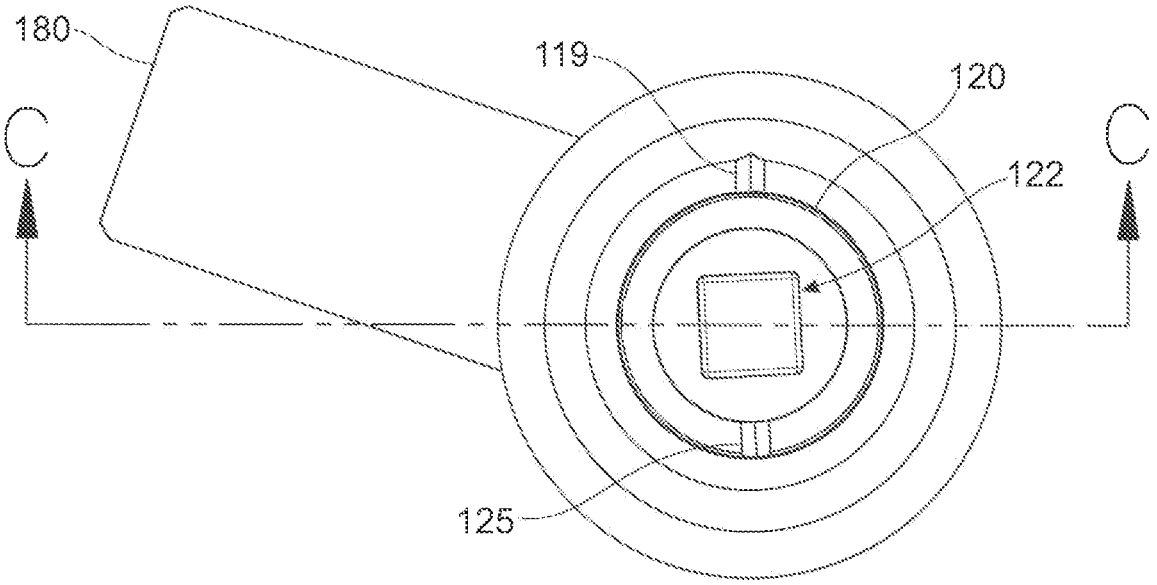
Figure 8C:
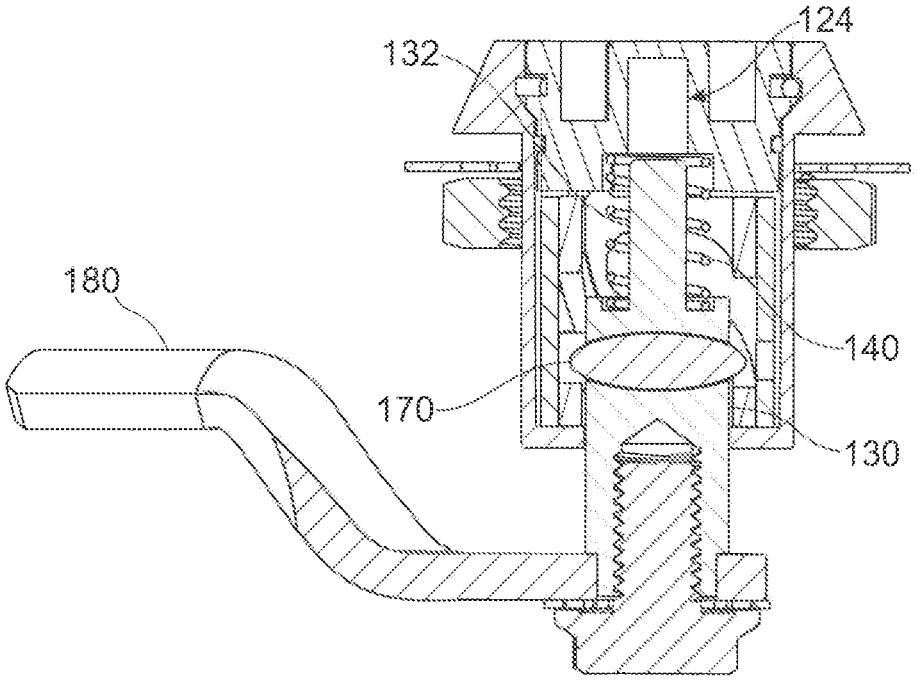

FIGS. 8A-8C show latch 100 in an open position, after pin 170 reaches the end of the second portion of L-shaped slot 154. Rotation of cap 120 and cam 160 may be continued until pin 170 reaches the end of slot 154, and no more rotational movement of pin 170 of shaft 130 is possible. As shown in FIGS. 8A and 8B pawl 180 has been fully rotated, and cannot engage frame 20. As shown in FIG. 8B, full rotation of cap 120 constitutes approximately 180° from the closed position, as shown by the different between indicators 118 and 125. It will be understood, however, that the rotational distance between the fully open and closed position may be any desired distance. As shown in FIC. 8C, shaft 130 has been fully rotated, and the cross-section of pin 170 shown in FIG. 8C is elliptical in shape (as it passes through the sidewalk of the cylindrical pin.

Figure 9A:
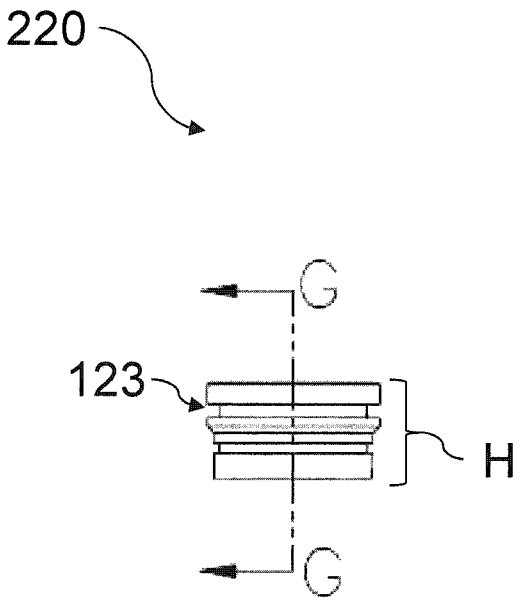
FIGS. 9A-9C depict an alternate exemplary cap of a latch in accordance with aspects of the present invention.
Figure 9B:
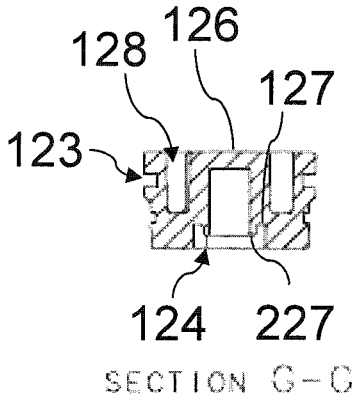
Figure 9C:
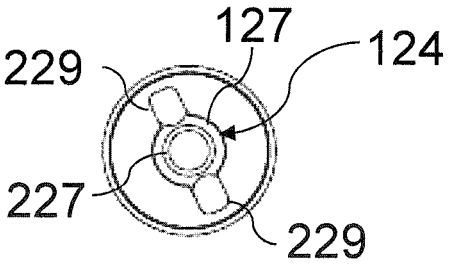

An alternative cap 220 is illustrated in FIGS. 9A-9C. Cap 220 may include all of the structures or features set forth above with respect to cap 120, except as set forth below.

Cap 220 further includes at least one longitudinally extending recess 124 formed in a lower surface of cap 220. Recess 124 includes a surface 127 therein which supports spring 140. Surface 127 of cap 120 is defined within recess 124, in order to reduce or further reduce the overall height H of cap 120.

Surface 127 includes an annular protrusion 227 in an inner edge thereof, as shown in FIG. 9B. Protrusion 227 extends toward the opening of recess 124. Protrusion 227 may promote proper seating of spring 140 against surface 127. Additionally, protrusion 227 may prevent guide portion 132 from deviating side-to-side in recess 124, and/or prevent guide portion 132 from contacting and/or interfering with spring 140.

Cap 220 further includes keying features 229 in the lower surface of cap 220, as shown in FIG. 9C. Keying features 229 mate with keying features 162 on cam 160. Unlike keying features 129, keying features 229 do not extend all the way to the periphery of cap 220. Keying features 229 may terminate before the periphery of cap 220, since cam 160 is narrower than cap 220, and mating keying features 162 are located radially inward from the periphery of cap 220.

Figure 10A:
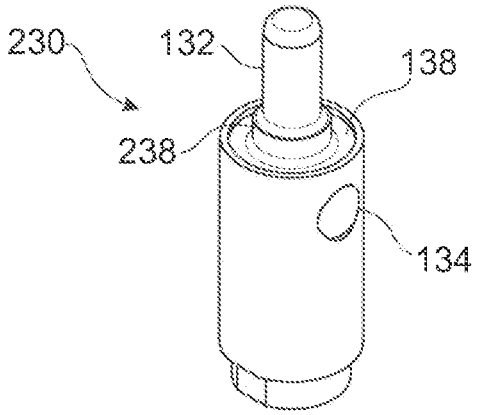
FIGS. 10A-10C depict an alternate exemplary shaft of a latch in accordance with aspects of the present invention.
Figure 10B:
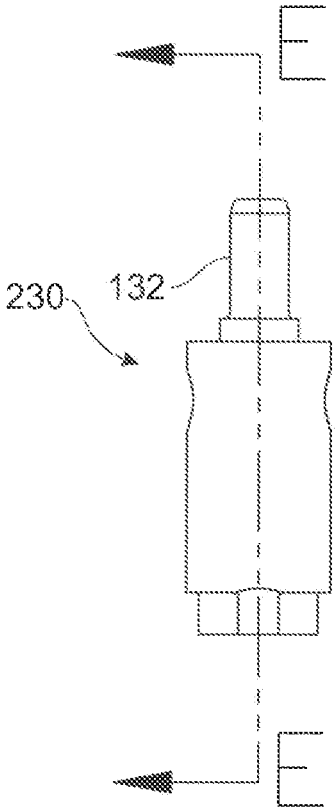
Figure 10C:
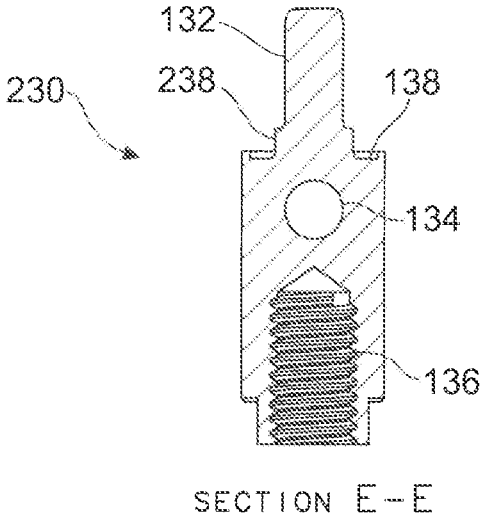

An alternative shaft 230 is illustrated in FIGS. 10A-10C. Shaft 230 may include all of the structures or features set forth above with respect to shaft 130, except as set forth below.

Shaft 230 includes a guide portion 132 extending upward from shaft 130, as shown in FIG. 10B. Guide portion 132 extends in the axial direction toward cap 220. Guide portion 132 is sized to be received within recess 124 of cap 220. The sliding engagement of guide portion 132 within recess 124 and inside protrusion 227 defines the direction of the axial movement of shaft 230 relative to cap 220.

Shaft 230 includes a surface 138 which supports spring 140 when spring 140 surrounds guide portion 132. Guide portion 132 may further include a flared section 238 adjacent surface 138, as shown in FIG. 10C. Flared section 238 may promote proper seating of spring 140 against surface 138. Additionally, flared section 238 may prevent spring 140 from deviating side-to-side adjacent guide portion 132.

Figure 11A:
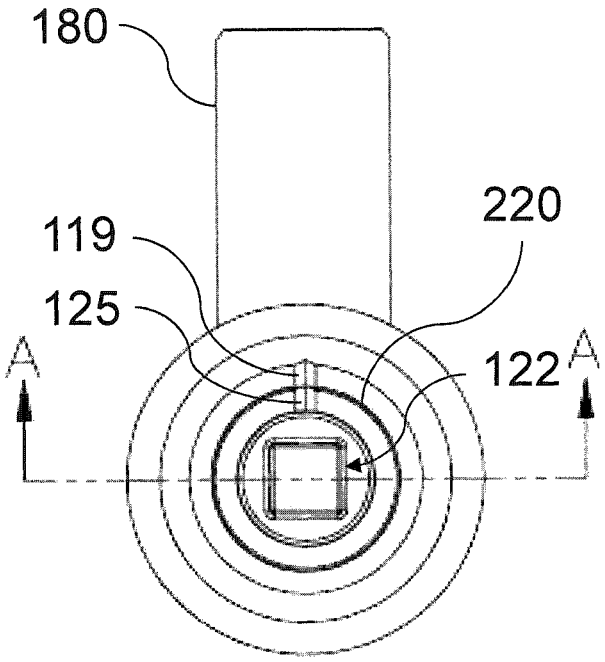
FIGS. 11A and 11B depict an alternate first step of an exemplary opening operation of a latch in accordance with aspects of the present invention.
Figure 11B:
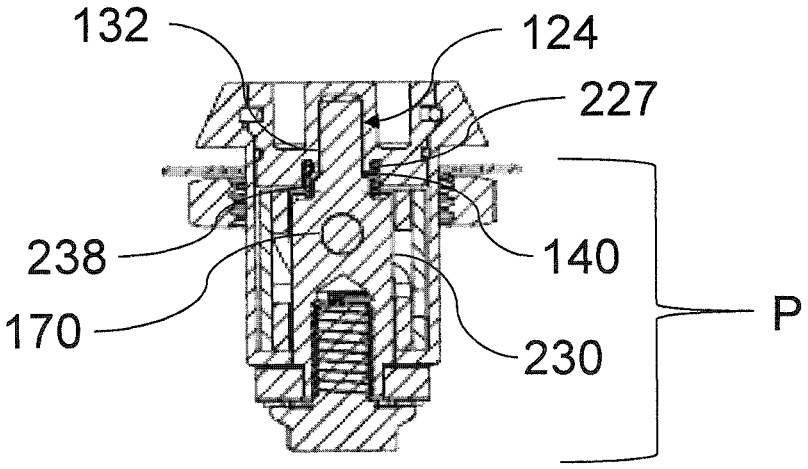

Steps of an alternate opening operation is illustrated in FIGS. 11A-12B. FIGS. 11A and 11B show a latch in the closed position. As shown in FIG. 11A, indicators 118 and 125 are aligned, indicating to the user that cap 220 is in the unrotated (secured) position. As shown in FIG. 11B, shaft 230 is at an axially uppermost position, with guide portion 132 fully received within recess 124 of cap 220 inside protrusion 227, and spring 140 fully compressed.

Figure 12A:
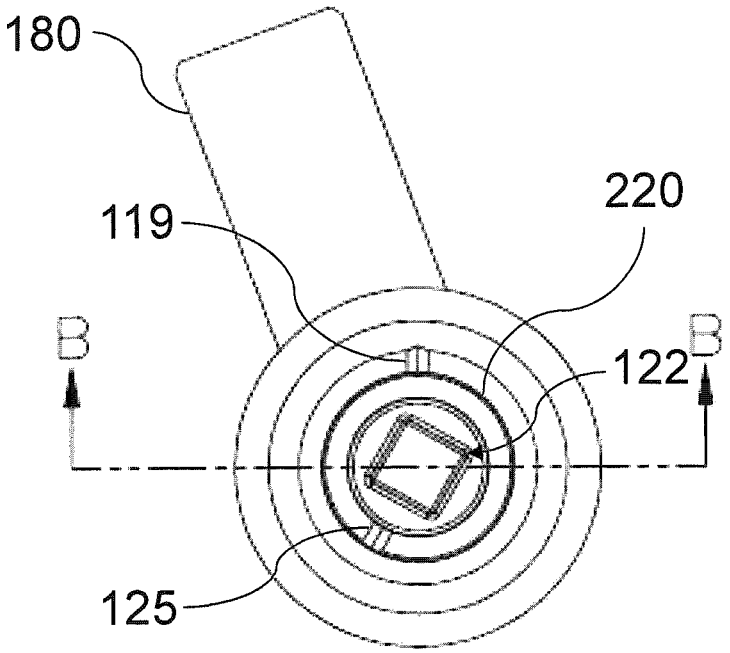
FIGS. 12A and 12B depict an alternate second step of the opening operation of FIGS. 11A and 11B.
Figure 12B:
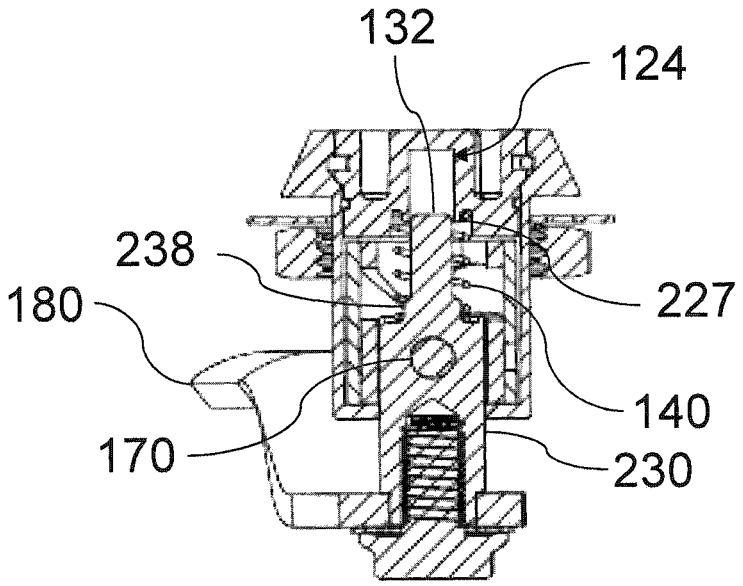
Figure 13B:
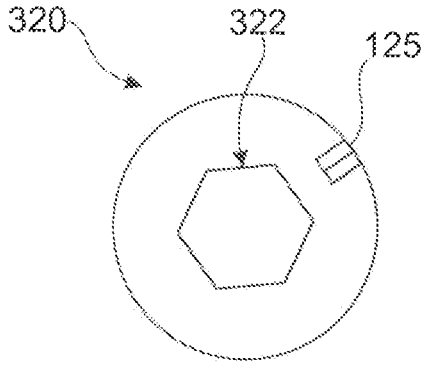
FIGS. 13A-13E depict another alternate exemplary cap of etch in accordance with aspects of the present invention.
Figure 13A:
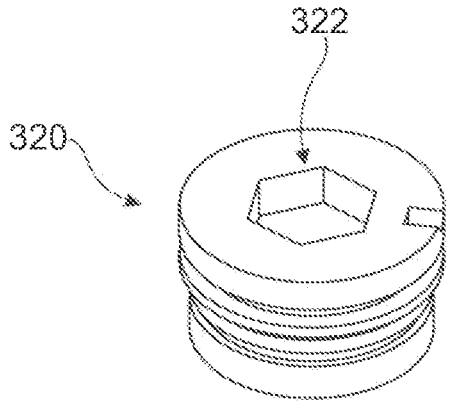
Figure 13C:
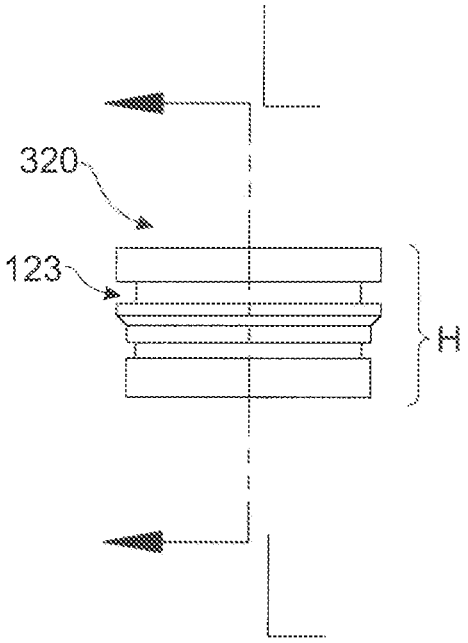
Figure 13E:
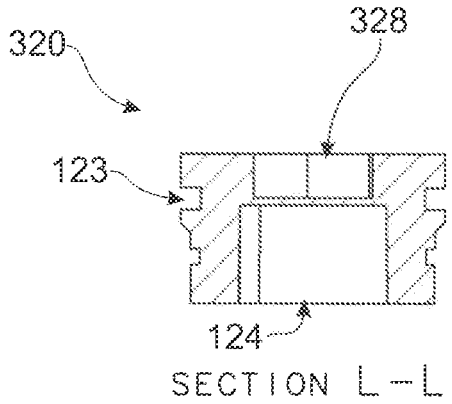
Figure 13D:
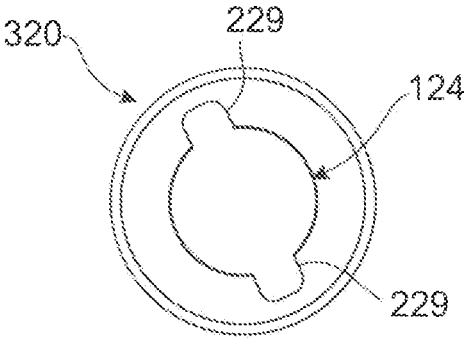

FIGS. 12A and 12B show a latch in a position between the opened and closed positions. Continued rotation of cap 220 causes pin 170, and correspondingly shaft 230, to move only in the rotational or circumferential direction. This rotational movement of shaft 230 moves pawl 180. As shown in FIG. 12A, indicators 118 and 125 are no longer aligned, as cap 220 has been rotated counterclockwise from the closed position. As shown in FIG. 12B, shaft 230 is at an axially lowermost position, with spring 140 fully extended. Protrusion 227 projects below the tip of guide portion 132, and thereby prevents guide portion 132 from deviating side-to-side in recess 124. Likewise, flared section 238 prevents spring 140 from deviating side-to-side adjacent guide portion 132.

Another alternative cap 320 is illustrated in FIGS. 13A-13E. Cap 320 may include all of the structures or features set forth above with respect to cap 120 and/or cap 220, except as set forth below.

Cap 320 includes at least one drive surface 322 on its upper surface, as shown in FIGS. 13A-13E. Drive surface 322 is provided in order to enable a user to drive or rotate cap 320 e.g., with a hexagonal key. In this embodiment, cap 320 comprises a drive opening 328 extending into an upper surface of cap 320 along the longitudinal axis. Drive opening 328 forms the drive surface 322 for rotating cap 320.

Cap 320 further includes at least one longitudinally extending recess 124 formed in a lower surface of cap 320. In this embodiment, there is no overlap between recess 124 and drive opening 328 in the radial direction of the housing. In other words, recess 124 extends longitudinally to a position that is either radially outward from or radially inward from drive opening 328.

Another alternative shaft 330 is illustrated in FIGS. 14A-14E. Shaft 330 may include all of the structures or features set forth above with respect to shaft 130 and/or shaft 230, except as set forth below.

Figure 14B:
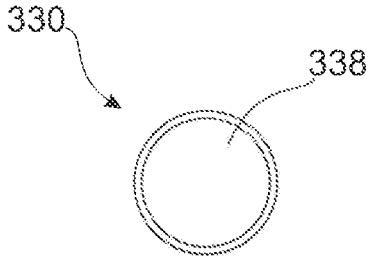
FIGS. 14A-14E depict another alternate exemplary shaft of a latch in ns accordance with aspects of the present invention.
Figure 14A:
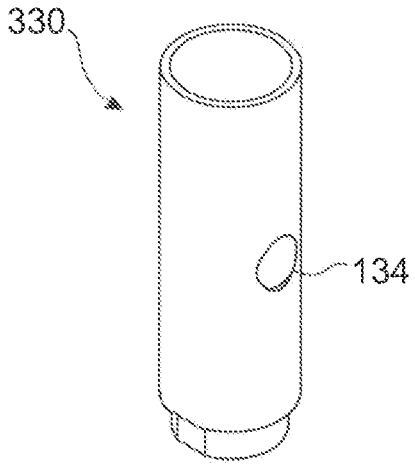
Figure 14C:
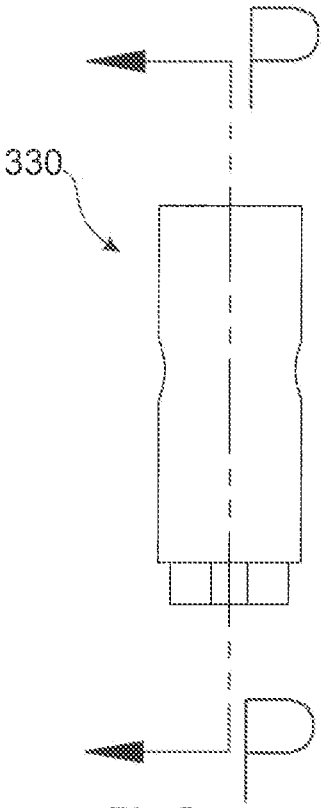
Figure 14E:
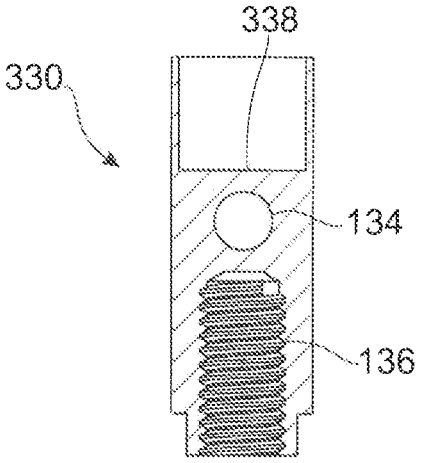
Figure 14D:
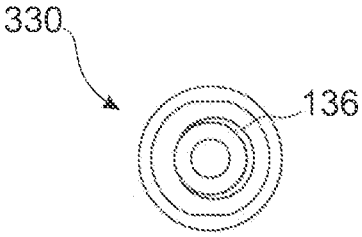

Shaft 330 includes no guide portion extending upward from shaft 130, as shown in FIGS. 14A, 14C, and 14E. In its place, shaft 230 includes a disc-shaped surface 338 which supports spring 140 when spring 140 is in place.

Figure 15A:
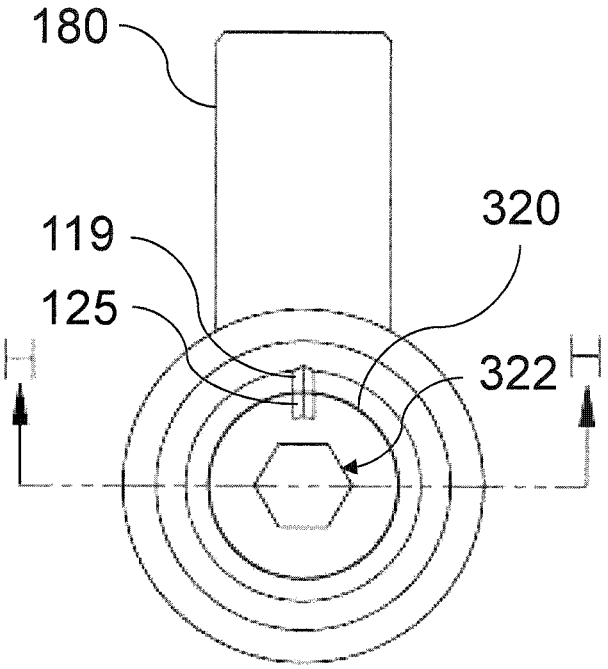
FIGS. 15A and 15B depict another alternate first step of an exemplary opening operation of a latch in accordance with aspects of the present invention.
Figure 15B:
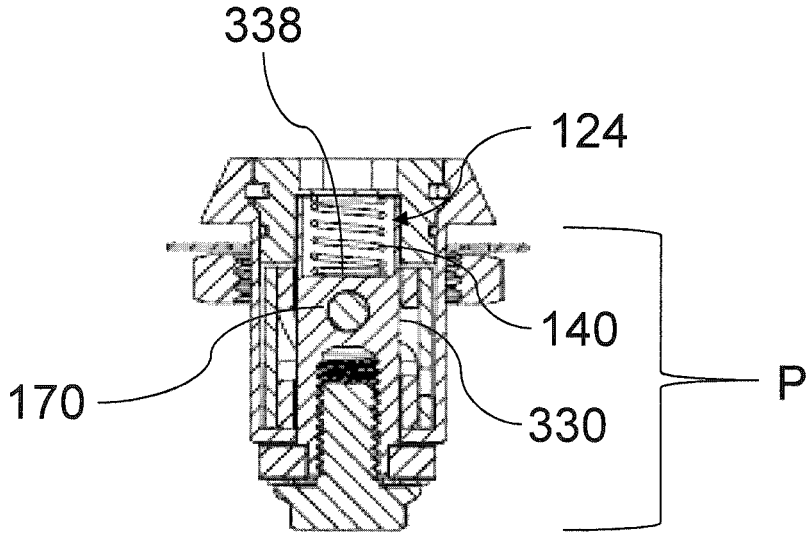

Steps of another alternate opening operation is illustrated in FIGS. 15-16. FIGS. 15 and 15 show a latch in the closed position. As shown in FIG. 15, indicators 118 and 125 are aligned, indicating to the user that cap 320 is in the unrotated (secured) position. As shown in FIG. 15B, shaft 330 is at an axially uppermost position, with spring 140 fully compressed between the upper surface of recess 124 and surface 338 of shaft 330.

Figure 16A:
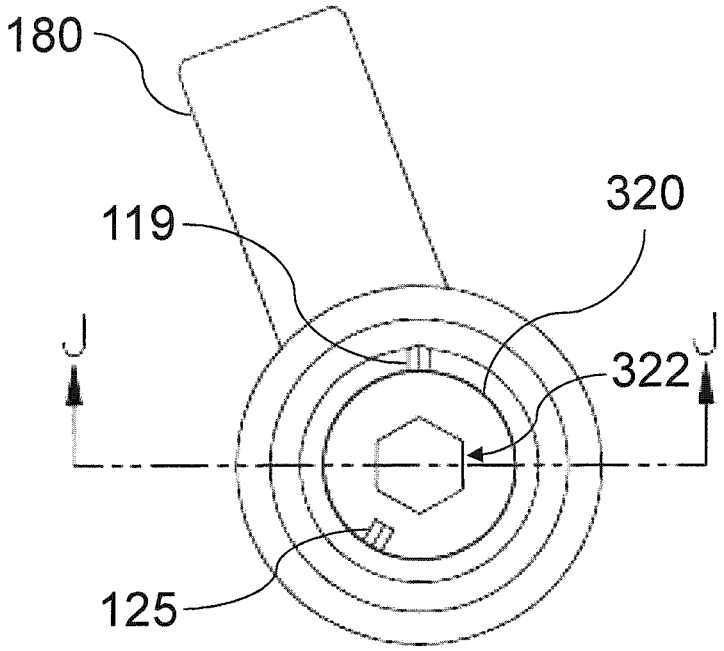
FIGS. 16A and 16B depict an alternate second step of the opening operation of FIGS. 15A and 15B.
Figure 16B:
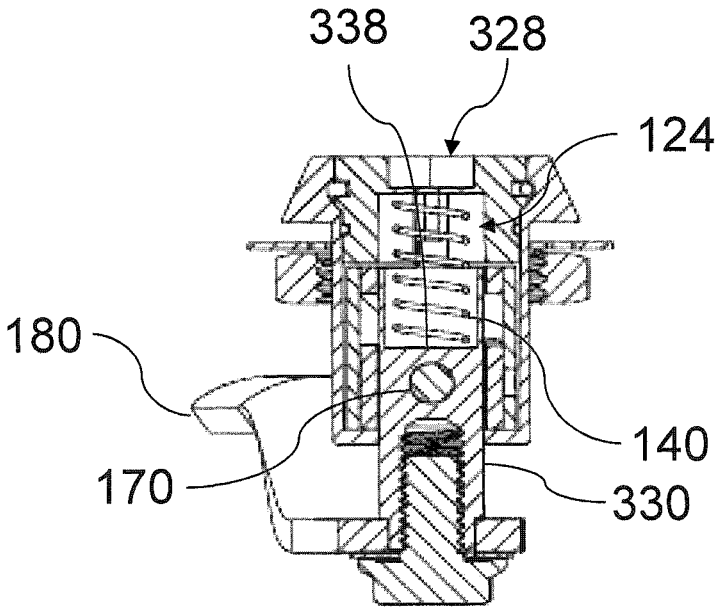

FIGS. 16A and 16B show a latch in a position between the opened and closed positions. Cap 320 is rotated, e.g., by insertion of a hexagonal key into drive opening 328. Rotation of cap 320 causes pin 170, and correspondingly shaft 330, to move only in the rotational or circumferential direction. This rotational movement of shaft 330 moves pawl 180. As shown in FIG. 16A, indicators 118 and 125 are no longer aligned, as cap 320 has been rotated counterclockwise from the closed position. As shown in FIG. 16B, shaft 330 is at an axially lowermost position, with spring 140 fully extended between the upper surface of recess 124 and surface 338 of shaft 330.

As noted previously, the exemplary latches described herein can have a lower protrusion as compared to conventional latches for enclosed spaces so as to reduce the area taken by the latches within those spaces. For example, when exemplary compression latches are used in connection with storage compartments, they can provide for a reduction of the degree of the protrusion of the latch into such compartments, thus decreasing or eliminating the effect of the latch on available storage space.

According to preferred aspects of this invention, this reduction of the degree of the protrusion of the latch is accomplished without compromising other performance benefits. For example, the invention makes it possible to reduce the degree of the protrusion of the latch as compared to conventional compression latches while at the same time maintaining at least one of or all of (1) the same pull-up or stroke of the latch's pawls as compared to conventional compression latches, (2) the same feel and smooth operation as compared to conventional compression latches, and (3) the same compressive force as compared to conventional compression latches.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A latch configured to fix a panel relative to a frame, the latch comprising:

a housing configured for engagement to the panel, the housing having a longitudinal axis and defining an aperture along the longitudinal axis;

a cap positioned within the aperture of the housing for rotation about the longitudinal axis, the cap defining a longitudinally extending recess;

a shaft extending along the longitudinal axis within the aperture of the housing, the shaft being configured for rotation about the longitudinal axis, the shaft further being configured for axial movement relative to the cap;

a spring configured to bias the shaft away from the cap along the longitudinal axis;

a sleeve interposed between the shaft and the housing, the sleeve defining a first slot;

a cam interposed between the shaft and the housing, the cam being rotatable relative to the sleeve about the longitudinal axis, the cam defining a second slot; and a pin extending radially outwardly from the shaft relative to the longitudinal axis, the pin extending into the first and second slots; and a pawl coupled to the shaft, the pawl being configured to engage the frame;

wherein the first and second slots are configured to guide the rotation and axial movement of the shaft as the cap is rotated within the housing such that the pawl engages or disengages the frame, wherein the cap comprises a drive stud extending in an axial direction along a portion of the longitudinal axis and forming a drive surface for rotating the cap, and wherein the recess of the cap extends in the axial direction along the portion of the longitudinal axis such that the recess is at least partially defined within the drive stud.

2. The latch of claim 1, wherein the cap defines a drive opening extending along the longitudinal axis and forming a drive surface for rotating the cap.

3. The latch of claim 2, wherein the recess of the cap overlaps with the drive opening in a radial direction of the cap.

4. The latch of claim 3, wherein the recess of the cap extends to a position radially outward from the drive opening.

5. The latch of claim 1, wherein the shaft has a guide portion movably received in the recess of the cap, and the spring is positioned to surround the guide portion of the shaft.

6. The latch of claim 5, wherein the spring extends between opposed surfaces of the shaft and the cap and has ends abutting the opposed surfaces.

7. The latch of claim 6, wherein the opposed surface of the cap is formed within the recess of the cap.

8. The latch of claim 7, further comprising an annular protrusion adjacent an inner edge of the opposed surface of the cap, the annular protrusion extending toward an opening of the recess of the cap.

9. The latch of claim 6, wherein the guide portion of the shaft includes a flared section adjacent the opposed surface of the shaft.

10. The latch of claim 1, wherein the spring includes one or more elements selected from the group consisting of compression springs, wave springs, Belleville washers, elastomeric springs, and/or conical springs.

* * * * *